United States Patent [19]

Wilson-Diehl

[11] Patent Number: 4,671,514

[45] Date of Patent: Jun. 9, 1987

[54] GAME BOARD DOLL

[76] Inventor: Brenda M. Wilson-Diehl, 35844 - 10th Ave., SW., Federal Way, Wash. 98023

[21] Appl. No.: 699,157

[22] Filed: Feb. 7, 1985

[51] Int. Cl.[4] ..... A63F 3/00

[52] U.S. Cl. ..... 273/287; 273/240; 273/DIG. 30; 273/284; 273/286; 273/282; 446/901; 446/100; 446/75; 434/84; 434/159; 434/188

[58] Field of Search ..... 273/241, 240, 287, 285, 273/286, DIG. 30; 446/100, 369, 74, 75, 77, 901, 72, 73, 98; 434/393, 396, 365, 308; 2/80, 111; D21/148

[56] References Cited

U.S. PATENT DOCUMENTS

| | | | |
|---|---|---|---|
| D. 108,084 | 1/1938 | Kingman | D21/175 |
| 1,262,821 | 4/1918 | Marks . | |
| 1,269,276 | 6/1918 | Harris | 273/286 |
| 1,868,427 | 7/1932 | Moore | 446/98 |
| 1,926,139 | 9/1933 | Browne | 434/365 |
| 3,357,116 | 12/1967 | Bazacos | 434/193 |
| 3,593,433 | 7/1971 | Dillon et al. | 434/308 X |
| 3,948,528 | 4/1976 | Goodman, Jr. et al. | 273/136 |
| 4,012,044 | 3/1977 | Grossi | 273/272 |
| 4,059,275 | 11/1977 | Price | 273/240 X |
| 4,122,628 | 10/1978 | Crowell et al. | 46/135 |
| 4,208,832 | 6/1980 | Corriveau | 46/22 |
| 4,225,137 | 9/1980 | Hebner | 273/284 X |
| 4,354,282 | 10/1982 | Langdon | 2/115 |
| 4,513,974 | 4/1985 | Lin | 273/284 X |

FOREIGN PATENT DOCUMENTS

| | | | |
|---|---|---|---|
| 983156 | 6/1951 | France | 446/73 |

OTHER PUBLICATIONS

Better Homes & Gardens advertisement for game towel, Bradford's Inc.

*Primary Examiner*—Richard C. Pinkham
*Assistant Examiner*—Matthew L. Schneider
*Attorney, Agent, or Firm*—Christensen, O'Connor, Johnson & Kindness

[57] ABSTRACT

A soft-sculptured, game board doll (10) includes a three-dimensional body portion (12) and removable hair (14), feet (16) and nose (18). A plurality of color markers (54) are selectively registrable over corresponding color areas (52) disposed about body (12). A plurality of different game boards (60), (62), (64), (68) and (69) are detachably securable to the back surface (70) of body portion (12).

16 Claims, 8 Drawing Figures

GAME BOARD DOLL

TECHNICAL FIELD

The present invention relates to toys, and more particularly to soft-sculptured dolls adapted to support one or more game boards thereon.

BACKGROUND OF THE INVENTION

Almost every child enjoys playing with dolls. Children often carry their dolls along with them no matter where they happen to be going, whether to bed, around the house or on a car trip. However, because of their limited attention span, children, especially younger children, often play with a succession of dolls and other types of toys. As a consequence, numerous toys typically are scattered about the child's play area, whether in the child's room or in a vehicle during traveling. Thus, it would be advantageous to provide a child with a toy which may be used for many functions, including; as a soft-sculptured doll; as an educational toy, for instance for learning the alphabet or numbers; for playing board games; and, for serving as a container for various objects, such as a child's blanket or pajamas.

Various types of soft-sculpture dolls have been constructed with removable and replaceable body portions for changing the appearance of a doll. Examples of this type of doll are disclosed by U.S. Pat. Nos. 4,122,628 and 4,208,832.

In addition, various types of game boards have been constructed from fabric or flexible materials. For instance, U.S. Pat. No. 1,262,821 discloses a checkers game board constructed from a sheet of rubber or rubberized textile fabric. U.S. Pat. No. 1,269,276 concerns an army and navy pillow kit having a checkers board disposed on the inside surface of the leather or fabric pillow. In addition, U.S. Pat. No. 3,948,528 discloses a fabric game boad which when not in use is wrapped around the exterior of a purse or tote bag.

SUMMARY OF THE INVENTION

A soft-sculptured doll is adapted for playing a plurality of different board games. The doll includes a body portion having an outer covering filled will resilient, compressible stuffing material to give the body a three-dimensional shape. A game board may be integrated into the outer covering of the doll. In addition, a plurality of different game boards, constructed from nominally planar material which is flexible to conform to the contour of the body, may be detachably secured to the body to overlie the outer covering of the body. The game boards may be detachably secured to the body by using strips or patches of hooked nap material which operably engage corresponding strips or patches of looped nap material. Preferably, the looped nap strips or patches are secured to the body, while the hooked nap strips or patches are secured to the back sides of the game boards. Of course, the relative locations of the hooked nap strips or patches and looped nap strips or patches may be reversed. The board games may be adapted to play numerous types of games appropriate for younger children, including tic-tac-toe, bingo, hangman, checkers, and various word games. In addition, a game board may be composed of flexible, smooth, nonabsorbant plastic material on which a child may draw or write with crayons or pens employing water based ink, whereby the crayon or ink may be easily erased with a soft cloth.

In a further aspect of the present invention, a pocket is formed in the interior of the doll body for storing the different game boards and game playing pieces when not in use. In addition, various articles may be stored in the pocket, which articles may serve as part or all of the stuffing material for the doll. Such articles include a child's pillow, blanket or various types of garments, for instance pajamas.

In a further aspect of the present invention, a plurality of spaced apart color areas are disposed about the outer covering of the doll. Ideally, the color areas are composed in part or in whole of looped nap material for detachably receiving color markers having back sides composed in part or in whole of hooked nap material. Various indicia, such as letters or numbers may be incorporated on the color areas and/or the front face of the color markers thereby to serve as a teaching device to assist small children in learning numbers or the alphabet.

BRIEF DESCRIPTION OF THE DRAWINGS

The details of a typical embodiment of the present invention will be described in connection with accompanying drawings, in which.

DETAILED DESCRIPTION

Figure 2:
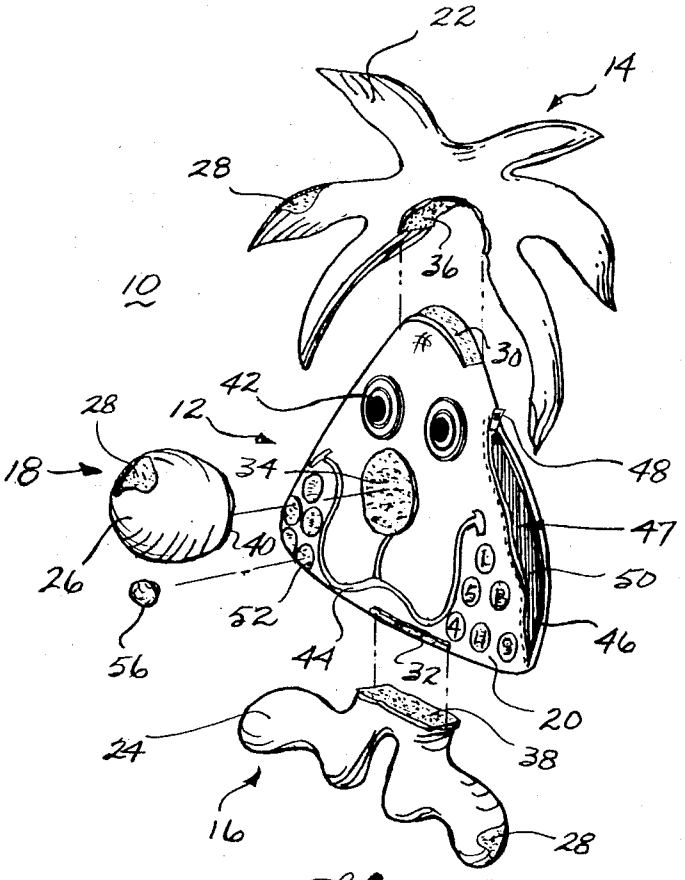
FIG. 2 is a view similar to FIG. 1 illustrating components of the game board doll as being exploded away from the body of the doll.
Figure 1:
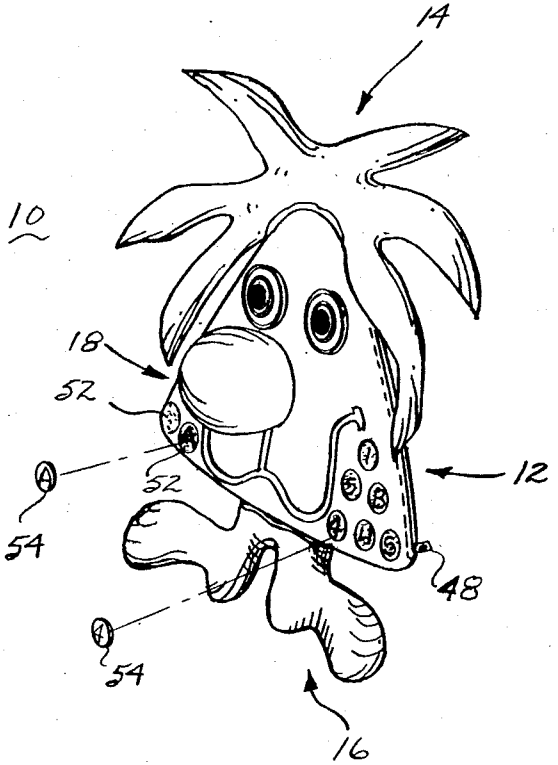
FIG. 1 is a front isometric view of a game board doll constructed according to the present invention.

Referring initially to FIGS. 1 and 2, a soft-sculptured, threedimensional board game doll, designated as 10 generally includes a body portion 12, removable hair 14, removable feet 16 and a removable nose 18. Ideally, these major components of the doll 10 are composed of outer coverings 20, 22, 24 and 26, respectively, filled with stuffing material generally designated as 28. Stuffing material 28 preferably is composed of cushion-like material, such as kapok or plastic foam, to give the doll a three-dimensional shape while still being soft and cuddy to the touch. Ideally, the outer coverings 20, 22, 24 and 26 are composed of any suitable material, including various types of woven textile fabrics, such as velour, corduroy or felt, which is stitched or otherwise fastened together to form cavitities for receiving the stuffing material 28.

Hair 14, feet 16 and nose 18 are detachably attached to body 12 by any convenient means. Ideally, however, strips or patches of a looped nap 30, 32 and 34 are disposed over the body outer covering 20 at attachment locations for hair 14, feet 16 and nose 18. Rather than being formed independently from body outer covering 20, the looped nap strips or patches 30, 32 and 34 may be an integral portion of the outer covering. As a further alternative, the entire outer covering 20 may be composed of a looped nap material. For coaction with the looped nap or patches comparable strips or patches of a hooked nap 36, 38 and 40, respectively, are secured to the portions of hair 14, feet 16 and nose 18 which contact against body 12. As with the looped nap strips/-patches, the hooked nap strips/patches may be actually incorpoated into the outer coverings 22, 24 and 26. It will be appreciated that by this construction, hair 14, feet 16 and nose 18 may be repetitively detached from and reattached to body 12.

The looped nap strips or patches and the hooked nap strips or patches may be formed from various types of materials, such as nylon. One such common type of looped and hooked nap nylon materials which may be employed with the present invention is sold under the trademark VELCRO.

It is to be understood that the hair 14, feet 16 and nose 18 shown in FIGS. 1 and 2 may be selectively replaced with comparable components of different shapes, thereby to give doll 10 different appearances as desired. Also, the replaceable components of doll 10 may be covered with outer coverings of different colors or materials, also to change the appearance of the doll as desired. Thus, with the basic doll body 12 and hair, feet and nose of various shapes covered with outer coverings of different fabrics or colors, a child could create a large number of different dolls as desired.

Figure 3:
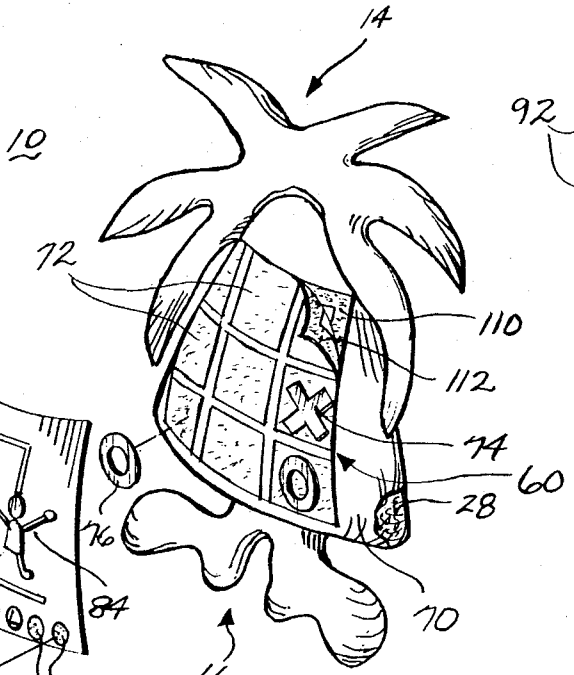
FIG. 3 is a rear isometric view of the game board doll illustrated in FIGS. 1 and 2 with a game board adapted to play tic-tac-toe mounted thereon and playing pieces for this game.

As shown in FIGS. 1, 2 and 3, body portion 12 of doll 10 is formed in a generally triangular, three-dimensional shape and consitutes the head and torso of the doll. The body portion could be formed in shapes other than generally triangular without departing from the spirit or scope of the present invention; however, as discussed more fully below, it is desirable that the body portion be of a shape to provide sufficient area on its backside for receiving various game boards. As noted above, body portion 12 is covered with an outer covering 20 which may be composed of many different types of materials having various textures and colors. Eyes 42 are mounted on the upper portion of body 12, which eyes preferably are sewn, rivetted or otherwise securely fastened to the body portion to prevent their accidental removal. An outline 44 defines the mouth of the doll. Preferably, the outline is composed of a contrasting color or fabric texture from that of the body outer covering 20.

In a further aspect of the present invention illustrated in FIGS. 1 and 2, body 12 is constructed with an opening 46 leading to an interior pocket or cavity 47. Although opening 46 is illustrated as extending along one side edge of body 12, it is to be understood that the opening can be positioned at other locations about the body, such as along mouth outline 44. Ideally, a slide fastener 48 is employed to open and close opening 46. The body pocket 47 may occupy the entire interior volume of the body or a portion of the volume of the body, in which case, preferably, an inner liner 50 is provided with an opening corresponding to outer covering opening 46. The volume or space between the outer cover 20 and the inner liner 50 is filled with conventional stuffing material, as described above. Various articles may be placed within pocket 47 to store the article and to serve as a portion of or the entire stuffing material for body 12. Such articles can include a child's pillow, blanket or garment, such as a pair of pajamas. Moreover, it will be appreciated that doll 10 itself can serve as a pillow for a small child. Also, the various game boards and playing pieces, described below, may be stored in pocket 47 when not in use.

Next referring particularly to FIG. 1, ideally a plurality of color areas 52 are disposed about the front or face side of body 12. The color areas can be of various different colors and shapes, such as circular, square, triangular, star-shaped, etc. The color areas may be composed of fabric or other types of materials disposed over outer covering 20, or they may be integrally formed with the outer covering. A plurality of corresponding color markers 54 are selectively registrable over the color areas. The color markers 54 may be of the same or different shape than color areas 52, and ideally the markers are the same size or larger in size than the color areas. The markers are selectively detachably engageable with the color areas 52 by any convenient means, such as by forming the entire or a portion of the color areas with a looped nap to coact with a hooked nap applied to the backsides of the color markers 54. By constructing the color markers and color areas in this manner, the markers may be repetitively engaged with and disengaged from the color markers without significantly reducing the ability of the color markers to bond to the color areas. Of course, the relative locations of the looped nap and hooked nap may be reversed without departing from the spirit or scope of the present invention.

By forming the color areas 52 of various different colors and the color markers 54 of colors matching the colors of the color areas, the present invention may be employed to teach a young child the names of various colors by having the child place the color markers over correspondingly colored areas 52.

In another aspect of the present invention, various types of indicia may be associated with color areas 52 and color markers 54. Such indicia may include the letters of the alphabet or numbers. The indicia may be incorporated as an integral portion of the markers 54 and areas 52, or the indicia may be in the form of additional material or fabric that is applied to the markers or areas. It will be appreciated that by constructing the markers and areas with numeric or alphabetic indicia, a young child could be taught the alphabet or numbers by locating such numbers or letters on areas 52 or by matching the markers with corresponding color areas.

It will be apprciated that rather than constructing color markers 54 as generally two-dimensional in shape, they can be formed as circular balls 56 or even as various objects, such as fruits, vegetables, animals, etc. As such, the present invention could be used as an instructional aid to teach young children the names of the foods and animals.

Next, referring specifically to FIGS. 3 through 8, various types of game boards 60, 62, 64, 66, 68 and 69 may be detachably applied to the back surface 70 of body outer covering 20. As shown in FIGS. 3 through 7, the game boards are especially adapted to play various different types of games, with game board 60 especially adapted to play tic-tac-toe, game board 62 especially adapted to play hangman, game board 64 especially adapted to playing checkers, playing surface 66 especially adapted to play various word games, and game board 68 especially adapted to play bingo. Each of the game boards is composed of thin, flexible material, which is "cloth-like" in nature in that it is capable of conforming to the contour of back surface 70. Ideally, the back surface is at least somewhat flat so that the above games may be conveniently played.

It is to be understood that one of the above or other type of game board may be integrally incorporated into back surface 70. As such, the doll 10 could be given a name which utilizes the name of the particular "built in" game, such as Harry Bingo or Tic-Tac Joe.

Considering the individual game boards, game board 60, FIG. 3, is divided into nine equal areas 72 arranged in a three-by-three matrix especially for playing tic-tac-toe. A plurality of playing pieces in the form of X's 74 and O's 76 may be provided for playing the game. Ideally, areas 72 are composed of a loope nap for cooperatively engaging with a hooked nap, not shown, applied to the back surfaces of playing pieces 74 and 76 for detachably attaching the playing pieces to areas 72. Of course the relative locations of the looped nap and hooked nap could be reversed.

Figure 4:
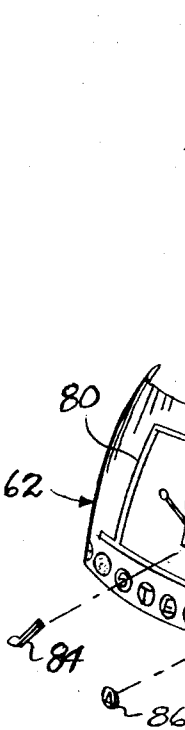
FIG. 4 is an isometric view of a game board and playing pieces adapted to play hangman.

Next, considering playing surface 62 shown in FIG. 4, this game board is especially adapted to play a "hangman" type game. As such, the game board 62 includes a hanging post 80 and a plurality of circular areas 82. In addition, a plurality of playing pieces 84 shaped generally to resemble portions of a human body and playing pieces 86 having letter indicia incorporated thereon are provided for playing the hangman game. Similarly to game board 62, the entire outer surface area or portions thereof may be composed of a looped nap for securely receiving thereon the playing pieces 84 and 86 which may include a hooked nap secured to or integrated into the backsides thereof.

Figure 5:
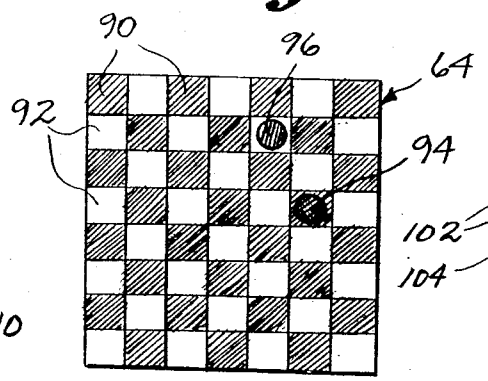
FIG. 5 is a plan view of a game board and playing pieces for playing checkers.

Game board 64 illsutrated in FIG. 5 is divided into a plurality of spaced-apart, substantially equal-sized square areas 90 and 92 arranged in an eight-by-eight matrix. Ideally, areas 90 are of a uniform color which is dissimilar from the color of areas 92 so that game board 64 is especially adapted to play checkers. A plurality of playing pieces 94 of a first color, such as the color of areas 90, and playing pieces 96 of a second color, such as the color of areas 92, are provided for playing checkers. Ideally, the outer surface of game board areas 90 and 92 are composed of a looped nap material for engaging with a hooked nap material disposed on one of the surfaces of playing pieces 94 and 96. Also, ideally, the other surfaces of the playing pieces are composed of looped nap material so that the playing pieces may be stacked on top of each other, such as when one of the playing pieces is "kinged". Of course, rather than being composed of looped nap material, the outer surface of game board 64 may be composed of a hooked nap without departing from the spirit or scope of the present invention.

Figure 6:
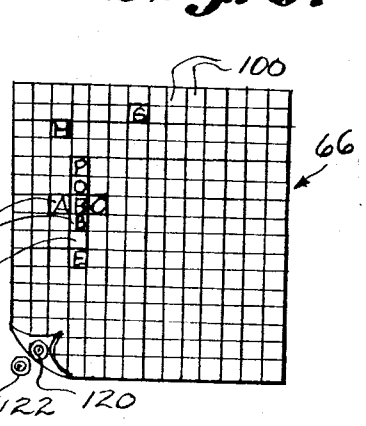
FIG. 6 is a plan view of a game board and playing pieces for playing various word games.

Next, referring to game board 66 illustrated in FIG. 6, this game board is divided into a plurality of equal-sized areas 100. A plurality of playing pieces 102, having alphabetic indicia incorporated thereon are provided for playing various types of work games, such as forming different words on the game board by placing pieces 102 over appropriate areas 100. Some of the playing pieces, designated as 104, may be left blank to serve as any letter so chosen by the player.

Figure 7:
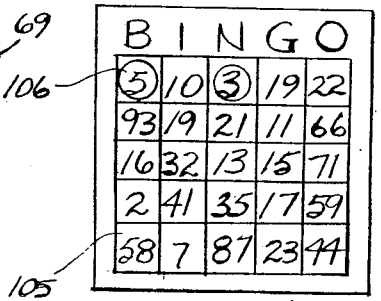
FIG. 7 is a game board and various playing pieces for playing bingo.

Game board 68, illustrated in FIG. 7 is especially adapted to play bingo. The game board has a plurality of generally square areas 105 divided into a 5×5 matrix as in a typical bingo card. The letters BINGO are diposed above the corresponding columns of areas 105. Ideally, areas 105 are composed of looped nap material for cooperatively and detachably receiving game pieces 106 having at least one surface composed of hooked nap material. Of course, as discussed previously, the relative locations of the looped nap and hooked nap may be reversed so that game board areas 105 are composed or covered with hooked nap material, while at least one surface of game pieces 106 is composed of or covered with looped nap material.

Figure 8:
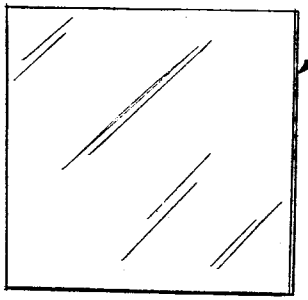
FIG. 8 is a game board composed of smooth, nonabsorbent, flexible plastic material which may be used as a writing or drawing surface.

The game board designated as 64, shown in FIG. 8, is composed of a flexible, smooth, nonabsorbent, plastic material capable of conforming to the contour of body rear surface 70. Forming game board 69 of this type of material will permit a child to write or draw on the game board with a waterbase pen or a wax-base crayon, and then erase the writing or drawing with a soft cloth. Thus, game board 66 serves as a writing or drawing board. Ideally, the game board 69 is of a light color such as white or beige so the colors of the crayons and pens stand out on the board.

It will be appreciated that the various playing pieces 74, 76, 84, 86 94, 96, 102, 104 and 106 may be conveniently stored within body pocket 47, thereby to be always available for use. Also, the particular game boards 60, 62, 64, 66, 68 and 69 when not in use also may be stored within pocket 47. As a result, no matter where a child desires to use the present invention to playing games, all the components required for the game are always at hand.

Referring specifically to FIG. 3, the game boards 60–69 preferably are detachably securable to back surface 70 by use of coacting looped nap and hooked nap connectors. Ideally, strips or patches 110 of looped nap material are disposed about the back surface 70 in registry with corresponding strips or patches 112 of hooked nap material disposed about the backsides of game boards 60, 62, 64, 66, 68 and 69. Rather than being arranged in individual discrete areas, the entire backsides of the game boards may be covered with hooked nap material to coact with a similar sized field of looped nap material overlying back surface 70. Alternatively, the entire back surface 70 may be constructed from looped nap material. Of course, as discussed above, the placement of the hooked nap material and the looped nap material may be reversed without departing from the spirit or scope of the present invention.

It is to be understood that the entire playing surfaces, or portions thereof of game boards 60, 62, 64, 66 and 68 may be composed of looped nap material to cooperatively detachably engage with the hooked nap material disposed on the back sides of a different board game. As such, the individual board games may be stacked on top of each other, with the uppermost board game being used. This eliminates having to store the board games in pocket 47, leaving the pocket available for receiving other items, such as the various playing pieces described above, a blanket, a pillow, or clothing.

As most clearly shown in FIG. 6, rather than employing strips or patches of looped and hooked nap material 110 and 112, the board games of the present invention may be attached to body 12 by the use of standard snap fasteners each having a male-type engagement member 120 mounted on the backsides of game board 68 in registry with a corresponding socket-type receiving member 122 secured to the back surface 70 of body outer covering 20. It will be appreciated that engagement members 110 and socket-type receiving members 112 may be in the form of the type of snap fastners commonly employed on clothing. Of course, the relative locations of engagement members 110 and socket-type receiving members 112 may be reversed from that illustrated in FIG. 6.

As will be apparent to those skilled in the art to which the invention is addressed, the present invention may be embodied in forms other than those specifically disclosed above without departing from the spirit or essential characteristics of the invention. The particular embodiments of the present invention, described above, are therefore to be considered in all respects as illustrative and not restrictive. The scope of the present invention is as set forth in the appended claims rather than being limited to the examples set forth in the foregoing description.

The embodiments of the invention in which an exclusive property or privilege is claimed are defined as follows:

1. A game board doll comprising:

(a) a three-dimensional soft-sculptured doll simulative of an animate being having an integral head and body, said integral head and body having an outer cover and resilient, compressible stuffing material disposed within said outer cover;

(b) a flexible, thin, substantially planar game board having indicia located thereon defining a pattern for playing a game, said game board being conformable to the contours of said integral head and body and overlying said integral head and body; and, (c) means for detachably securing said game board on said integral head and body so that said game board overlies said integral head and body.

2. The game board doll according to claim 1, wherein said game board comprises smooth, nonabsorbent plastic material capable of erasably receiving crayon and water-base ink.

3. The game board doll according to claim 1:

wherein said game board indicia comprises substantially equal-sized regions arranged in an N-by-N matrix, wherein N is a number from 3 to 8 inclusive;

further comprising a plurality of playing pieces; and, means for repetitively detachably attaching said playing pieces on desired game board regions.

4. The game board doll according to claim 1:

(a) wherein said game board indicia comprises a hanging post and a plurality of playing piece receivable areas incorporated into said game board, said playing piece receivable areas presenting a nap selected from the group consisting of a looped nap and a hooked nap;

(b) further comprising a plurality of first playing pieces having indicia incorporated thereon and having back surfaces comprising either hooked nap or a looped nap for coactive, repetitive, detachable attachment of said first playing pieces to said playing piece receivable areas of said game board; and, (c) further comprising a plurality of second playing pieces simulative of portions of a human body, said second playing pieces having back surfaces comprising either a hooked nap or a looped nap for coactive, repetitive, detachable attachment to said game board.

5. The game board doll according to claim 1:

(a) wherein said game board indicia comprises a plurality of substantially equal-sized areas of two different colors arranged in an eight-by-eight matrix, with adjacent areas being of a different color;

(b) further comprising a plurality of first playing pieces of a first color;

(c) further comprising a plurality of second playing pieces of a color different than the color of said first playing pieces; and, (d) further comprising means for repetitively detachably attaching said first and second playing pieces on said game board.

6. The game board doll according to claim 5, wherein said attachment means comprises a looped nap or a hooked nap disposed on said game board color areas, and a coacting hooked nap or looped nap, respectively, disposed on said first and second playing pieces.

7. The game board doll according to claim 1:

(a) wherein said game board indicia comprises a plurality of substantially equal-sized areas;

(b) further comprising a plurality of playing pieces having indicia incorporated thereon; and, (c) further comprising means for detachably attaching said playing pieces on said game board.

8. The game board doll according to claim 7, wherein said indicia on said playing pieces comprise alphabetic letters.

9. The game board doll according to claim 7, wherein said means for repetitively detachably attaching said playing pieces to said game board include a nap selected from the group consisting of a looped nap disposed on said game board for coacting with a hooked nap disposed on said playing pieces and a hooked nap on said playing surface for coaction with a looped nap on said playing pieces.

10. The game board doll according to claim 1, wherein said means for detachably securing said game board on said integral head and body comprises a nap selected from the group consisting of a looped nap on the outer cover of said integral head and body for coaction with a hooked nap on the backside of said game board at locations in registry with the locations of the looped nap on said outer cover and a hooked nap on said outer cover for coaction with a looped nap on the backside of said game board at locations corresponding to the locations of the hooked nap on said outer cover of said integral head and body.

11. The game board doll according to claim 1, wherein said means for detachably securing said game board on said integral head and body comprises a plurality of snap fasteners selected from the group consisting of:

(a) a plurality of socket-type receiving members mounted on said outer cover and a plurality of male-type engagement members mounted on said game board in registration with the corresponding socket-type members on said outer cover; and, (b) a plurality of male-type engagement members mounted on said game board outer cover and a plurality of socket-type receiving members mounted on said game board in registration with corresponding male-type engagement members on said outer cover.

12. The game board doll according to claim 1:

(a) wherein said outer cover of said integral head and body includes a plurality of spaced-apart color areas;

(b) further comprising a plurality of color markers having indicia thereon and selectively registrable over said color areas; and, (c) means for repetitively detachably securing said color markers to said color areas.

13. The game board doll according to claim 12, wherein said color areas have numeric indicia and said color markers have corresponding numeric indicia.

14. The game board doll according to claim 12, wherein said color areas have alphabetic indicia, and said color markers have corresponding alphabetic indicia.

15. The game board doll according to claim 1:

(a) wherein said integral head and body having portions defining a pocket thereon;

(b) wherein said outer cover having portions defining an opening in registry with said pocket;

(c) wherein said stuffing material is removable from said pocket through said opening; and, (d) means for selectively opening and closing said outer cover opening.

16. The game board doll according to claim 15, wherein said stuffing material is selected from the group consisting of a pillow, a blanket and a garment.

* * * * *